US009194115B1

(12) United States Patent
Green

(10) Patent No.: US 9,194,115 B1
(45) Date of Patent: Nov. 24, 2015

(54) MOUNTABLE URINE RESERVOIR

(76) Inventor: Frank P. Green, Tulare, CA (US)

( * ) Notice: Subject to any disclaimer, the term of this patent is extended or adjusted under 35 U.S.C. 154(b) by 0 days.

(21) Appl. No.: 10/197,773

(22) Filed: Jul. 18, 2002

(51) Int. Cl.
*E03D 1/22* (2006.01)
*E03D 13/00* (2006.01)
*E03D 1/00* (2006.01)

(52) U.S. Cl.
CPC ..... *E03D 13/00* (2013.01); *E03D 1/003* (2013.01)

(58) Field of Classification Search
CPC ..... E03D 13/00; E03D 1/00; E03D 1/003
USPC ..... 4/340–342, 301, 144.1, 144.4, 463, 4/310, 458, 144.3; 239/599; 141/340, 141/341
See application file for complete search history.

(56) References Cited

U.S. PATENT DOCUMENTS

| | | | | | |
|---|---|---|---|---|---|
| 2,309,786 | A | * | 1/1901 | Porter | 239/552 |
| 3,500,480 | A | * | 3/1970 | Michal, Jr. | 4/301 |
| 3,822,419 | A | * | 7/1974 | Wilson, Sr. | 4/144.4 |
| 4,750,219 | A | * | 6/1988 | Williams | 4/301 |
| 5,285,532 | A | * | 2/1994 | Sealy | 4/144.3 |
| 5,737,779 | A | * | 4/1998 | Haddock | 4/301 |
| 5,799,340 | A | * | 9/1998 | Hubrig et al. | 4/342 |
| 6,021,531 | A | * | 2/2000 | Kirko | 4/144.3 |

* cited by examiner

*Primary Examiner* — Huyen Le
(74) *Attorney, Agent, or Firm* — Andrew D. Fortney; Central California IP Group, P.C.

(57) ABSTRACT

The mountable urine reservoir is a device designed to address a common problem that exists in commodes installed in mobile vehicles. Because the motion of the vehicle may jostle a person attempting to stand while urinating it is common for urine to splash outside of the commode. This is highly unsanitary. The present invention eliminates this defect in the current systems by providing whereby a person can urinate standing up while inserting their penis within the barrel of a reservoir. Thus the walls of said reservoir would prevent any urine from splashing to the exterior.

15 Claims, 4 Drawing Sheets

MOUNTABLE URINE RESERVOIR

BACKGROUND OF THE INVENTION

1. Field of the Invention

The present invention relates to an improvement on the current devices installed on mobile vehicles for receiving urine during expulsion. Included is a distinct and improved reservoir for receiving urine and dispensing said urine into a commode while also providing a convenient mounting system for said reservoir.

2. Description of the Prior Art

As today's society has become more mobile it has become commonplace for vehicles to be designed with commodes that can be used while the vehicle is in transport. Commodes can be found in airplanes, boats, buses, trucks, mobile homes, and trains to name a few. While these conveniences have proven to be invaluable assets, the combination has not been without fault. When males expel urine into the standard commodes installed on vehicles, the jostling of the vehicle can lead to a lack of control of the urine's trajectory. The result is that the urine will land on the exterior of the commode, the floor, or the surrounding walls. This is highly unsanitary and unpleasant. Thus a device that would receive all urine expelled by a male in the standing position despite, being jostled, would be a vast improvement on the prior art.

As described earlier, all of the devices for receiving urine on moving vehicles employ the standard seated commode. This design typically resembles a stool with an opening in the seat that is designed to receive human excrement. The only accommodation that exists for the male expulsion of urine in the standing position is that the seat of the commode can typically be lifted so that any urine that is splashed will not land thereon. While this design is adequate for stationary commodes, the bumps and turns of a moving vehicle can cause the user to miss the commode altogether. There are no devices in the prior art that recognize this fault and rectify it. The present invention comes from the realization that a reservoir is needed that is at an elevated level so that these accidents will not occur. The invention can be installed for use with preexisting arrangements at low cost. While there are other reservoir designs for the receipt of urine, most of these designs are for separate units. None of these provide for a permanent mounting system that makes the reservoir readily available to the user of a mobile commode.

U.S. Pat. No. 4,202,058 to Robert W. Anderson and Carlos Witzke U.S. Pat. No. 5,091,998 are for urinals designed for use by a female, particularly those that do not have access to a commode. The similarities to the present invention relate to the use of a urine receptor cup that is attached to a hose by a port for the transport of urine. The cup designs however are distinctly different. The Anderson '058 and Witzke '998 design incorporate a cup that is suited for the female anatomy while the present invention is for the male anatomy. The primary difference is that the port orientation on the cup for these patents are located at a downward angle from the mouth of the cup which accommodates the female anatomy while the present invention consists of a port directly below the mouth of the cup thus being designed to suit the male anatomy. The present invention incorporates a dispensation design on the opposite end of the hose that is readily adaptable to most commodes while the Anderson '058 patent is designed to dispense the urine by a pumping mechanism. The Witzke '998 patent covers only a cup and hose design. Also unique to the present Invention is a mounting system for the cup that makes it possible to mount the present invention immediately next to a commode and to be used either mounted or grasped for use. This design feature is crucial to the present inventions utility in mobile vehicles and is not disclosed in the Anderson '058 patent or the Witzke '998 patent.

The urine conducting apparatus disclosed in U.S. Pat. No. 3,964,111 to Paul R. Packer uses a cup and port design as well. The cup and its mouth are shaped with a curved design intended for the female anatomy and does not incorporate the barrel shaped structure of the present invention. Thus splashing due to jostling will be a far greater risk in the Packer '111 design. The Packer '111 design is for a receptor cup only and has none of the features of the present invention for mounting and adapting for a commode.

U.S. Pat. No. 4,121,306 to Bernard B. Bringman and Des. 357,979 to Oneita A. Evans are for urinals that are attached to a container by a hose. The port-mouth orientation of these inventions is arranged for the male anatomy and this respect more closely resembles the present invention. However, the dispensing design for theses inventions is for the hoses to enter a container where said container incorporates a mounting receptor to hold the end of the hose in place. The present invention on the contrary includes a special design feature that allows the end of the hose to be mounted on the rim of a commode and thus be used permanently with that commode. In addition, neither the Bringman '306 nor Evans '979 patents disclose a means for mounting said cups for repeated usage in mobile vehicles.

U.S. Pat. Des. 213,557 is for a portable bidet that has a basin design that substantially resembles the standard bidet. A hose feeds into two tubes that are connected to both spray nozzles of the bidet. This hose is attached to a fitting that is designed to be mounted on a spout so that water will be fed to the abovementioned nozzles. The fitting is not suited for the mounting system of the present invention and is not meant for the purpose of receiving urine. The interface between the hose and the bidet is greatly different then the present invention and would not be readily adaptable to standard mobile commodes.

Therefore a need exists for a novel and enhanced device for receiving urine on mobile vehicles. Combining these tasks in a single unit would increase efficiency and minimize the use of storage space. In addition, the design should maximize the safety of the user. In this respect, the mountable urine reservoir according to the present invention substantially departs from the conventional concepts and designs of the prior art, and in doing so provides an apparatus primarily developed for the purpose of receiving urine in a mobile vehicle.

SUMMARY OF THE INVENTION

In view of the foregoing disadvantages inherent in the known types of devices for receiving urine now present in the prior art, the present invention provides an improved combination of adaptability and utility, and overcomes the abovementioned disadvantages and drawbacks of the prior art. As such, the general purpose of the present invention, which will be described subsequently in greater detail, is to provide a new and improved mountable urine reservoir which has all of the advantages of the prior art mentioned heretofore and many novel features that result in a mountable urine reservoir which is not anticipated, rendered obvious, suggested, or even implied by the prior art, either alone or in combination thereof.

In furtherance of this objective, the mountable urine reservoir comprises a mount wherein said mount comprises a hole for connection to a wall and further comprises a keeper for a cup. Said cup is attached to a hose the opposite end of which is mountable on a commode for dispensing urine. There has been outlined, rather broadly, the more important features of the invention in order that the detailed description thereof that follows may be better understood and in order that the present contribution to the art may be better appreciated.

The abovementioned keeper on said mount comprises two L-shaped fingers positioned so that a urine cup having a upper portion that is wider then the space between said fingers will rest in place and can be removed by lifting said cup in a vertical direction. Said fingers will allow the urine cup to rest in place while attached to a hose that passes to a commode.

In an alternate design of the present invention said mount comprises a recess. At the base of said recess is a ridge. Said urine cup comprises a groove in the bottom wherein said groove will receive said ridge when said cup is inserted into said recess. Said ridge thus holds said cup in place by resisting the weight of said cup.

Another feature of the present invention is a dispenser spout that attaches to the opposite end of said hose. Said dispenser comprises a bent open-mouth design that rests permanently on the rim of a commode and dispenses the urine into the bowl of said commode.

The cup of the present invention is uniquely shaped to allow for either of the abovementioned mounting methods. In addition said shape comprises a long barrel to fully accommodate the male anatomy in a manner so that urine will be expelled within the interior portion of said cup and therefore allow no splashing.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mountable urine reservoir that has all of the advantages of the prior art and none of the disadvantages.

It is another object of the present invention to provide a new and improved mountable urine reservoir that may be easily and efficiently manufactured and marketed.

An even further object of the present invention is to provide a new and improved mountable urine reservoir that has a low cost of manufacture with regard to both materials and labor, and which accordingly is then susceptible of low prices of sale to the consuming public, thereby making such mountable urine reservoir economically available to the buying public.

Still another object of the present invention is to provide a new mountable urine reservoir that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
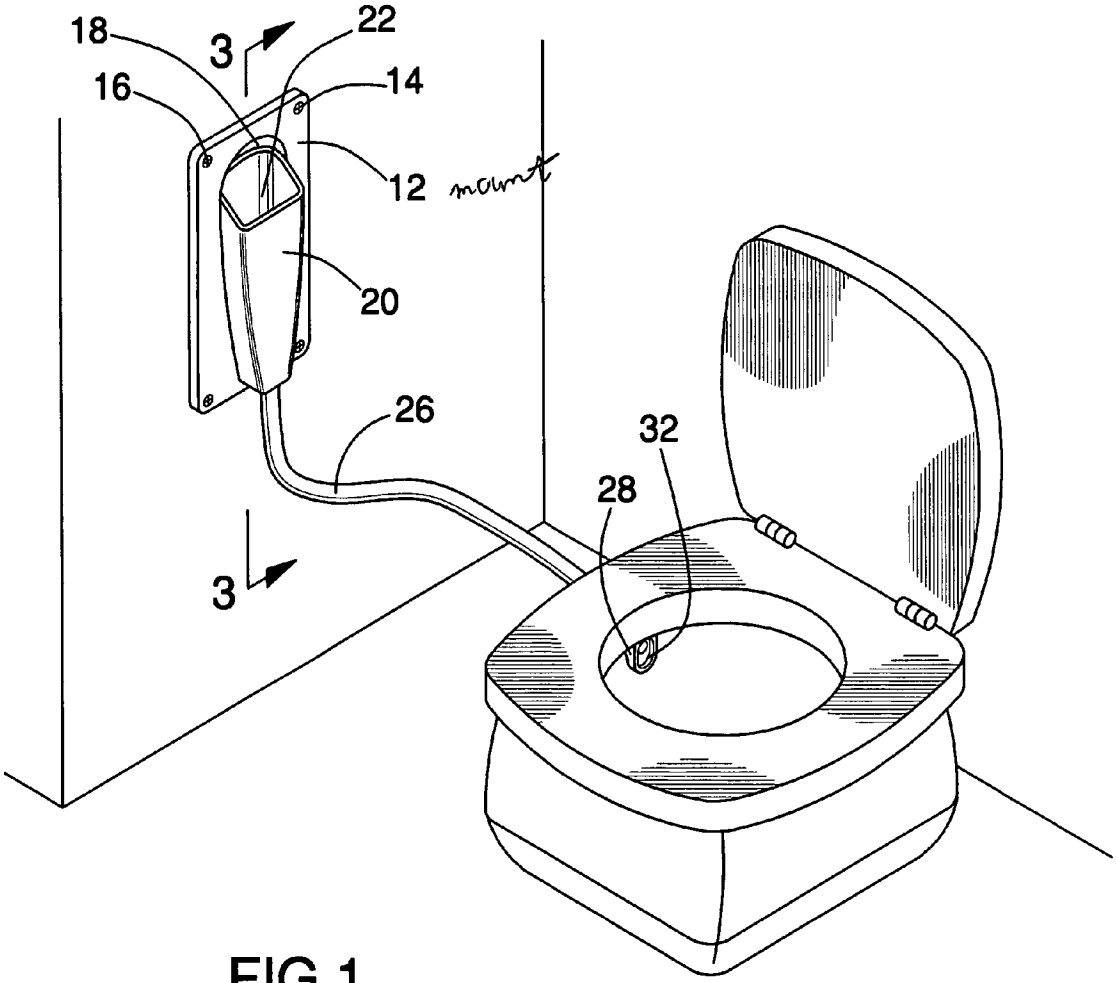
FIG. 1 is a left perspective view of the first preferred embodiment of the mountable urine reservoir of the present invention.

Referring now to the drawings, and particularly to FIGS. 1-5, a preferred embodiment of the mountable urine reservoir of the present invention is shown and generally designated by the reference numeral 10.

In FIG. 1 is a rectangular wall mount 12 comprising four holes 14 passing through the four corners of said mount 12 wherein the diameter of said holes 14 are sized to receive standard fasteners 16 such as screws, bolts, or nails. Said fasteners 16 will pass through said holes 14 and the heads of said fasteners will lie flush against the exterior surface of said mount 12. The remainder of said fasteners penetrates a wall and is firmly attached therein. In the first alternative of the preferred embodiment said mount 12 comprises a recess 18 located in the central portion of the face of said mount 12. Said recess 18 comprises a flat bottom edge and a curved upper edge. The dimensions of said recess 18 is such that a urine reservoir 20 will fit within said recess and rest therein. A hole in the wall would be cut to snugly receive said recess 18 so that the outer portion of said mount 12 remains flush against the wall for mounting by the abovementioned fasteners 16. Said mount 12 can be made of any variety of lightweight easily molded material such as wood, plastic or metal. Many ornamental shapes can be incorporated.

Also pictured in FIG. 1 is a urine reservoir 20 that comprises a rectangular cup. Said cup comprises a mouth 22 wherein said mouth further comprises a sectional area that is great enough to receive the male penis. Said cup further comprises a rectangular barrel comprising a length great enough to receive a penis while not contacting the walls of said reservoir 20. The bottom portion of said reservoir 20 comprises a port 24 wherein said port is attached to a hose 26. Said bottom portion also narrows to a smaller sectional area so that said reservoir 20 acts as a funnel to said port 24. Said cup 20 would be made of a plastic material that could be easily cleaned and replaced by a new cup.

Connected between said reservoir 20 and a commode is a hose 26. The upper end of said hose 26 is attached to the bottom portion of said reservoir 20. The lower portion of said hose 26 passes beneath the seat of a commode and above the rim of said commode. Said lower portion is attached to a dispenser spout 28. Said spout 28 hangs over the edge of said rim and has an oval shaped mouth 32. The upper portion of said spout 28 comprises an inlet tube 30 that is attached to said hose 26 and passes into said oval shaped mouth 32. As urine exits said hose 26 it enters said inlet tube 30 and passes out of said mouth 32 of said spout into the bowl of the commode. Said hose 26 can be made of rubber and should have ample length to reach from a commode and the neighboring wall.

Figure 2:
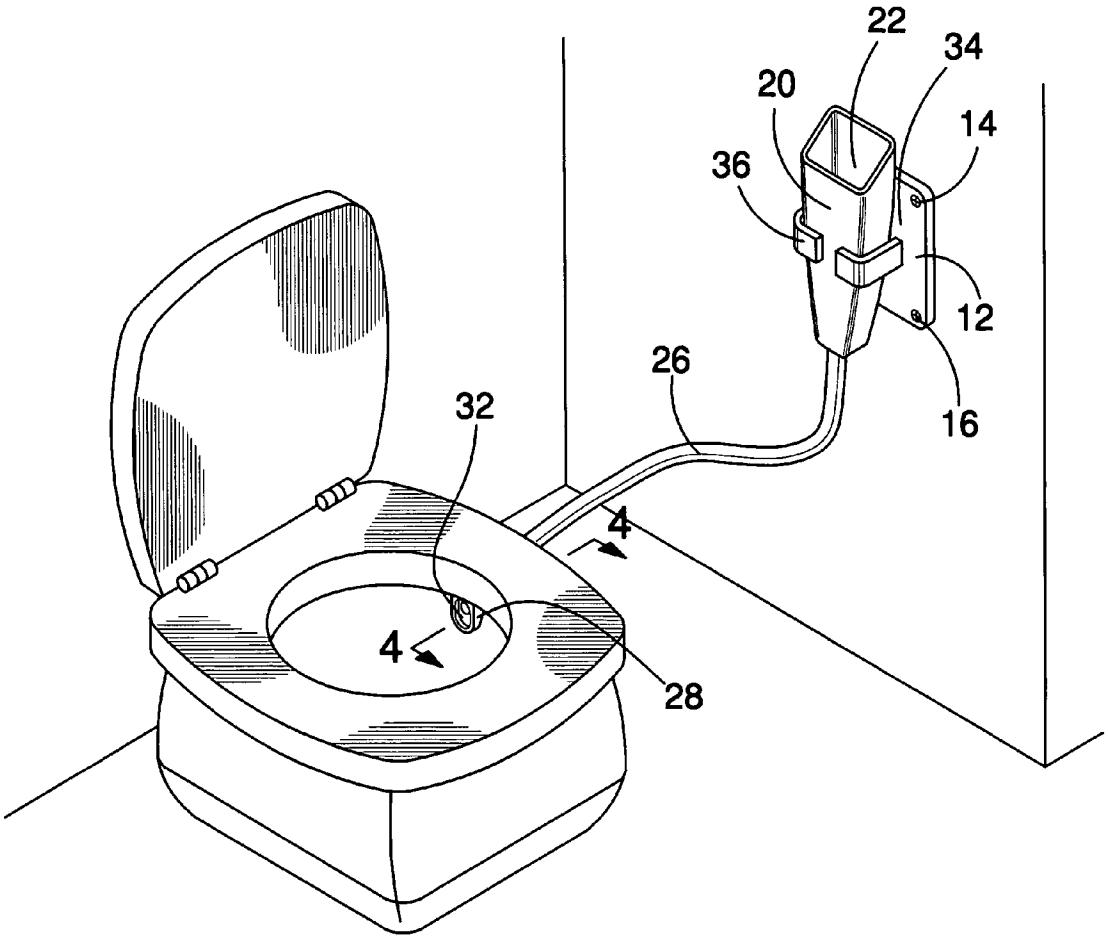
FIG. 2 is a right perspective view of the second preferred embodiment of the mountable urine reservoir of the present invention.

In FIG. 2 the alternate design for said mount 34 is pictured. In this design said mount 34 comprises a rectangular plate wherein said plate comprises four holes 14 located at each of the four corners and has a diameter sized to receive a fastener 16 such as a screw, bolt, or nail. Like the previous design, said fasteners 16 would pass through said holes 14 and penetrate a wall. The head of said fasteners lies flush against said mount 34 and holds said mount 34 in place. Attached to the external face of said mount 34 is a pair of L-shaped fingers 36 wherein one end is attached to said face of said mount 34 and the other ends are positioned opposite of one another. Said fingers 36 are positioned close enough so that said reservoir cup 20 having the same design described above will pass through the space between said fingers 36 at its narrower bottom portion and the wider upper portion will rest frictionally between said fingers 36. Thus the user can lift said reservoir 20 upwardly to remove it from the mount and can reinsert it for remount. Several other bracket designs can be incorporated as long as they can facilitate ready removal and insertion. Said mount and fingers can be made of plastic, metal or wood.

The remaining design is substantially the same as that of the first alternative. The only difference is that no groove 38 would be necessary in the bottom of said reservoir. This design allows the user to install the present invention without cutting to accommodate said recess 18. The hose and dispenser spout arrangement of the second alternative is identical to the arrangement of the first alternative.

Figure 3:
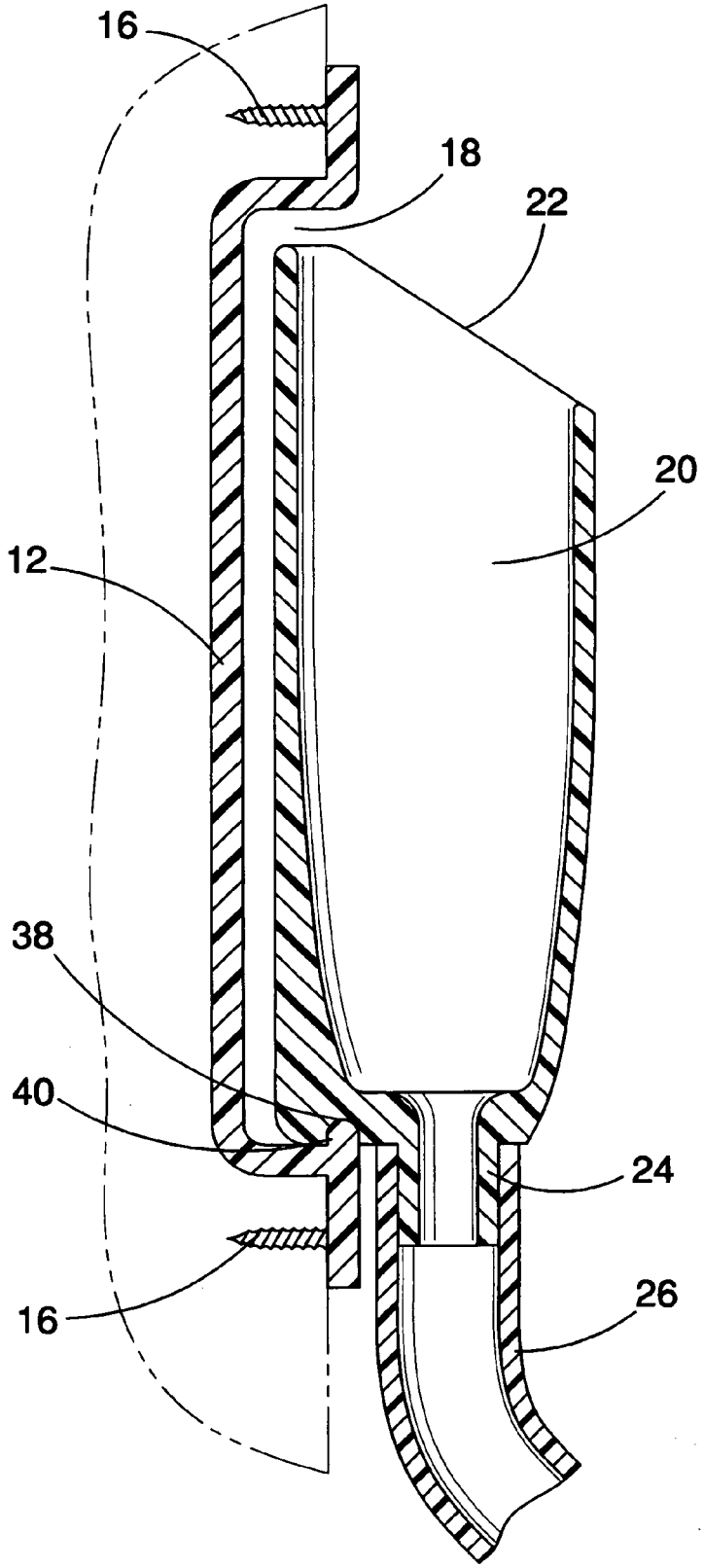
FIG. 3 is a sectional side view of the mounted cup portion of the second preferred embodiment of the mountable urine reservoir of the present invention.

The sectional view of FIG. 3 is a side view of the mounting plate and reservoir arrangement of the first alternative for the preferred embodiment. The Upper and bottom portions illustrate a sectional view of the face portion of said mount 12 wherein said face comprises a hole for receiving a fastener 16 which penetrates a wall and firmly couples said mount 12 to said wall. The middle portion is a recess 18 wherein the upper and lower walls of said recess 18 are attached to said face and are perpendicular thereto. Said recess 18 comprises a back wall which is attached to said upper and lower walls. Attached to the point of connection between said lower wall and said face is a ridge 40. The installation of this embodiment would require that a hole be cut in said wall so that said recess 18 would fit within it, but said face would overlap said wall for mounting. A template could be included with the present invention to allow the user to make a exact outline of the desired shape to fit said recess 18.

The back wall of said reservoir 20 comprises flat surface that has a length that is slightly smaller then the length of said back wall of said recess 20. The bottom portion of said reservoir 20 comprises a groove 38 adjacent to the rear portion. Said groove 38 is shaped to receive said ridge 40 on said lower wall of said recess 18 and to hold said reservoir 20 in place in a resting position. Attached to the front portion of the bottom of said reservoir 20 is a port. Said port is cylindrical and has an outer diameter that is slightly larger then the inner diameter of said hose 26 so that said hose 26 can be stretched to snuggly fit over said port 24. The front side of said reservoir 20 curves forward to define an upper mouth 22 that is wider then the lower portion of said reservoir 20. The upper edge of said front wall is shorter then said rear wall Thus the mouth 22 of said reservoir 20 slants forward. The angle of this design accounts for the male anatomy so that the user can expel urine within the interior of the barrel of said reservoir where none can splash to the exterior. The lower portion of said reservoir 20 narrows, forming a funnel so that the urine will pass freely into said hose 26 which will convey said urine into the bowl of a commode via said dispenser spout 28.

Figure 4:
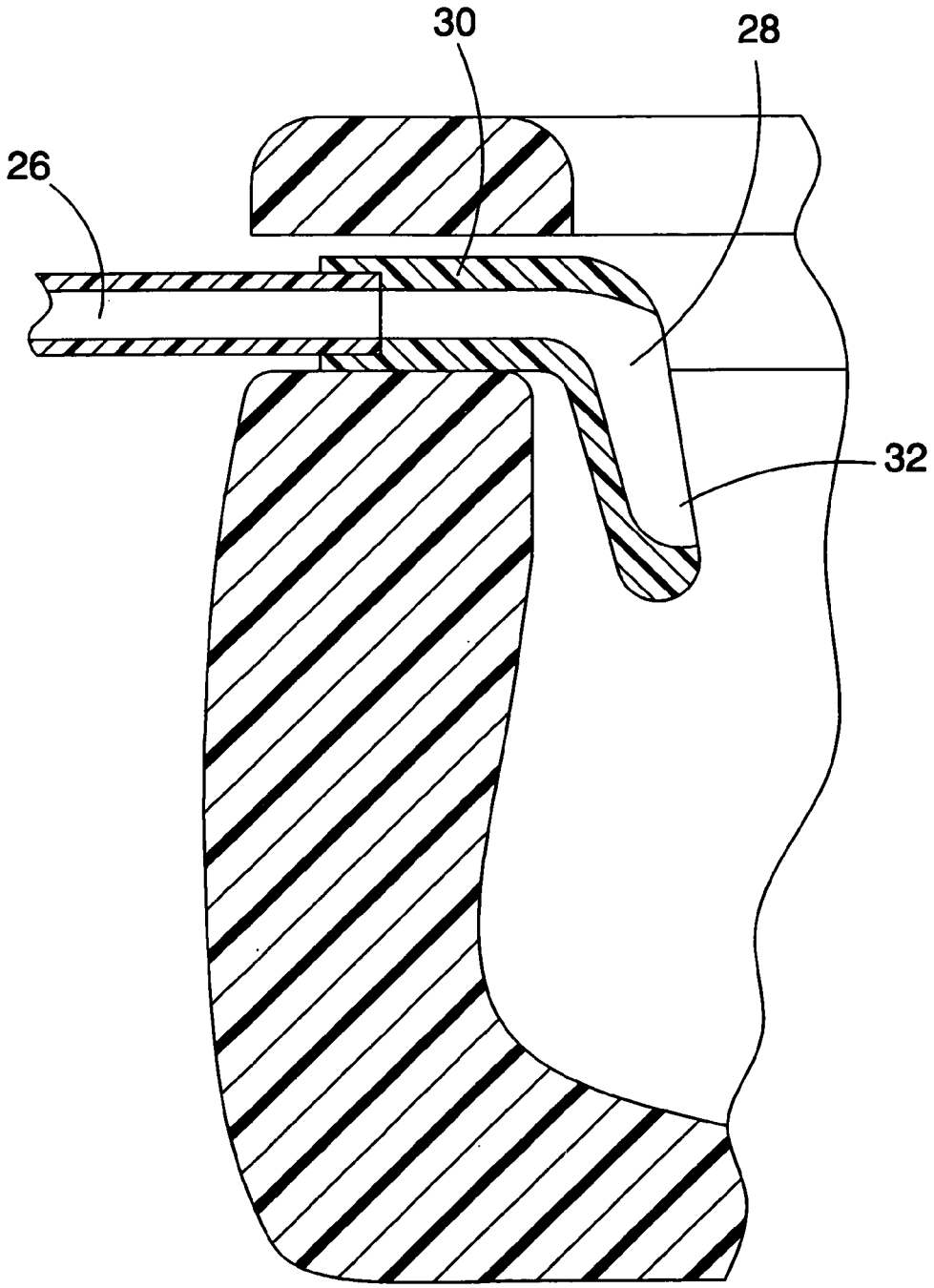
FIG. 4 is a sectional side view of the dispenser spout of the mountable urine reservoir of the present invention wherein the dispensing end rests on a commode. The same reference numerals refer to the same parts throughout the various figures.

The sectional view in FIG. 4 illustrates the permanent mounting mechanism of the present invention for said hose 26 to dispense the urine into a commode. Said hose 26 connects to said inlet tube 30 of said dispenser spout 28. The outer diameter of said hose 26 is slightly smaller then the inner diameter of said inlet tube 30. Said hose 26 is inserted and held in place within said dispenser inlet tube 30. The opposite end of said tube widens to create an oval shaped mouth 32 that acts as the spout portion of said dispenser spout 28. The bottom half of said tube 30 widens dramatically while the upper portion extends outward. The resulting shape has a crooked lower edge that hangs over the edge of the rim of a commode. The seat of said commode rest on top of said dispenser 28 and the weight of said seat holds said spout 28 in place. The wide mouth 32 facilitates smooth flow of urine from the dispenser 28 into the bowl of said commode. The ease and malleability of rubber would make the material an excellent choice for said dispenser spout 28. Said inlet tube must be made of a material with strong enough rigidity to prevent collapse due to the weight of the seat. A heavy-duty rubber should amply accommodate this need.

While a preferred embodiment of the mountable urine reservoir 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention. For example, any suitable flexible material may be used instead of the fabrics that have been described. And although the slicing of food product has been described, there are slight variations, such as shape and size that would make the invention appropriate for other items.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mountable urine reservoir comprising:

a mount wherein said mount comprises a platform and wherein said platform comprises a rear surface and an exterior surface and wherein said exterior surface of said mount further comprises a concave hollow and wherein said concave hollow further comprises a lower edge;

a rib attached to said lower edge of said concave hollow;

a rectangular reservoir comprising a groove and a hole in the bottom of said reservoir and wherein said reservoir further comprises a mouth at the top of said reservoir and wherein said mouth comprises a rear and front edge;

a port attached to said hole in said reservoir; and a hose comprising a first and a second end and wherein said first end is attached to said port.

2. The mountable urine reservoir of claim 1 comprising a dispenser spout wherein said spout comprises a inlet tube and an oval shaped outlet and wherein said inlet tube is attached to said second end of said hose.

3. The mountable urine reservoir of claim 1 wherein said port comprises a cylindrical shape and said first end of said hose attaches to the outer surface of said port.

4. The mountable urine reservoir of claim 1 wherein said rear surface comprises a convex surface.

5. The mountable urine reservoir of claim 1 wherein said mouth slants downward from said rear edge to said front edge.

6. The mountable urine reservoir of claim 1 wherein said platform has a plurality of holes formed therein.

7. The mountable urine reservoir of claim 1, wherein said reservoir comprises a tapered rectangular outer surface.

8. The mountable urine reservoir of claim 1, wherein said mouth has a first circumference and said hole has a second circumference, and said second circumference is less than said first circumference.

9. The mountable urine reservoir of claim 1, wherein said reservoir comprises a tapered rectangular outer surface.

10. The mountable urine reservoir of claim 1, wherein said mouth has a first circumference and said hole has a second circumference, and said second circumference is less than said first circumference.

11. A mountable urine reservoir comprising:

a dispenser spout wherein said spout comprises an inlet tube and an oval shaped outlet;

a hose comprising a first and a second end and wherein said second end is attached to said inlet tube;

a reservoir comprising a bottom and a mouth and wherein said bottom comprises a hole;

a port attached to said hole and to said hose; and a mount wherein said mount comprises a platform and wherein said platform comprises a rear surface and an exterior surface and wherein said exterior surface of said mount further comprises a concave hollow and wherein said concave hollow further comprises a lower edge wherein said mountable urine reservoir further comprises a rib attached to said lower edge of said concave hollow.

12. The mountable urine reservoir of claim 11 wherein said port comprises a cylindrical shape and said first end of said hose attaches to the outer surface of said port.

13. The mountable urine reservoir of claim 11 wherein said rear surface of said platform comprises a convex surface.

14. The mountable urine reservoir of claim 11 wherein said mouth slants downward from said rear edge to said front edge.

15. The mountable urine reservoir of claim 11 wherein said bottom of said reservoir comprises a groove.

* * * * *